US006142250A

United States Patent [19]

Griffin et al.

[11] Patent Number: 6,142,250

[45] Date of Patent: Nov. 7, 2000

[54] ROTARY DRILL BIT HAVING MOVEABLE FORMATION-ENGAGING MEMBERS

[75] Inventors: Nigel Dennis Griffin, Whitminster; John Michael Fuller, Nailsworth, both of United Kingdom; Alex Newton, Houston, Tex.; Malcolm Roy Taylor, Gloucestershire, United Kingdom; Andrew Murdock, Stonehouse, United Kingdom; Steven Taylor, Cheltenham, United Kingdom

[73] Assignee: Camco International (UK) Limited, Stonehouse, United Kingdom

[21] Appl. No.: 09/066,160

[22] Filed: Apr. 24, 1998

[30] Foreign Application Priority Data

Apr. 26, 1997 [GB] United Kingdom ..... 9708428

[51] Int. Cl.[7] ..... E21B 10/62

[52] U.S. Cl. ..... 175/381; 175/382; 175/426

[58] Field of Search ..... 175/381, 374, 175/379, 426, 432, 382, 383, 384

[56] References Cited

U.S. PATENT DOCUMENTS

| | | | |
|---|---|---|---|
| 1,879,226 | 9/1932 | Heddy . | |
| 1,978,006 | 10/1934 | Wright | 175/381 |
| 2,198,849 | 4/1940 | Waxler | 175/381 |
| 3,664,755 | 5/1972 | Carns | 408/159 |
| 4,261,425 | 4/1981 | Bodine . | |
| 4,382,477 | 5/1983 | Barr | 175/410 |
| 4,386,669 | 6/1983 | Evans | 175/269 |
| 4,690,229 | 9/1987 | Raney | 175/325 |
| 4,718,505 | 1/1988 | Fuller . | |
| 4,842,083 | 6/1989 | Raney | 175/325 |
| 5,343,964 | 9/1994 | Leroy | 175/61 |
| 5,361,859 | 11/1994 | Tibbitts | 175/286 |
| 5,388,649 | 2/1995 | Iiomaki | 175/27 |
| 5,553,678 | 9/1996 | Barr et al. . | |
| 5,560,440 | 10/1996 | Tibbitts | 175/384 |
| 5,582,260 | 12/1996 | Murer et al. | 175/76 |
| 5,678,645 | 10/1997 | Tibbitts et al. | 175/426 |
| 5,906,245 | 5/1999 | Tibbitts et al. | 175/426 |

FOREIGN PATENT DOCUMENTS

| | | |
|---|---|---|
| 448266 | 12/1974 | U.S.S.R. . |
| 2021664 | 12/1979 | United Kingdom . |
| 2154485 | 9/1985 | United Kingdom . |
| 2183694A | 6/1987 | United Kingdom . |
| 2306989A | 5/1997 | United Kingdom . |
| WO 89/02023 | 3/1989 | WIPO . |
| WO 95/21317 | 8/1995 | WIPO . |

*Primary Examiner*—Hoang Dang
*Attorney, Agent, or Firm*—Jeffrey E. Daly

[57] ABSTRACT

Formation engaging elements are moveably mounted onto a drill bit. Such elements may be used to protect other rigidly mounted formation engaging elements from impacts that occur during use of the drill bit, or they may be used to alter the aggressiveness of the drill bit when used in directional drilling operations.

36 Claims, 9 Drawing Sheets

FIG. 18
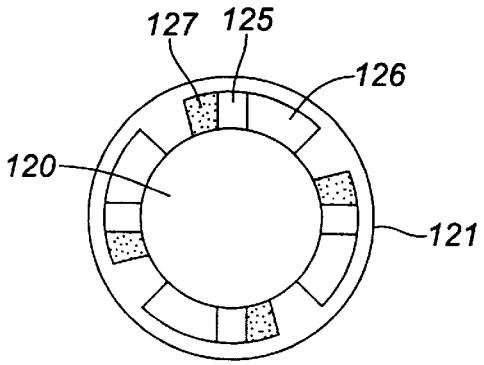
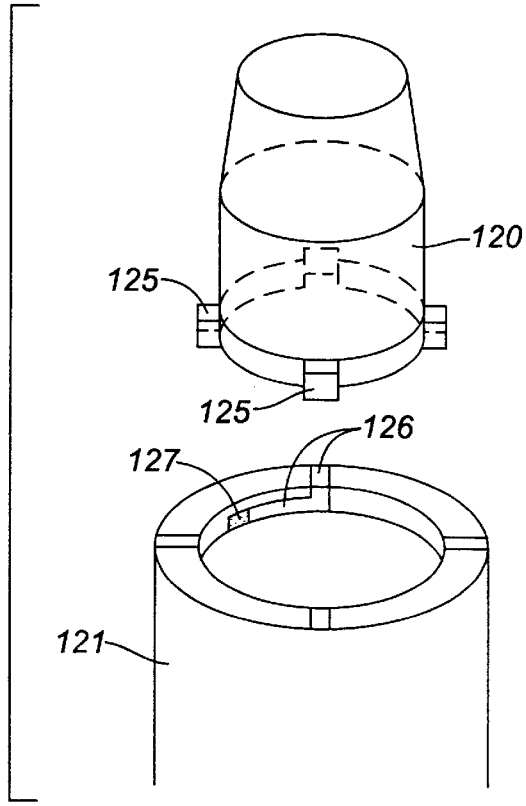
FIG. 19
FIG. 20
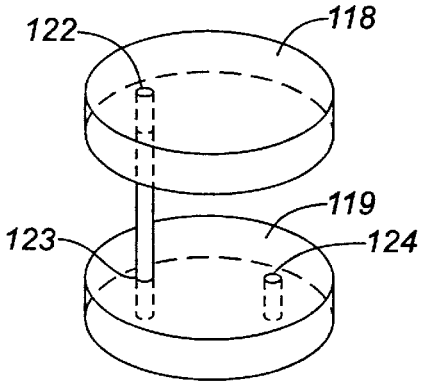
FIG. 21
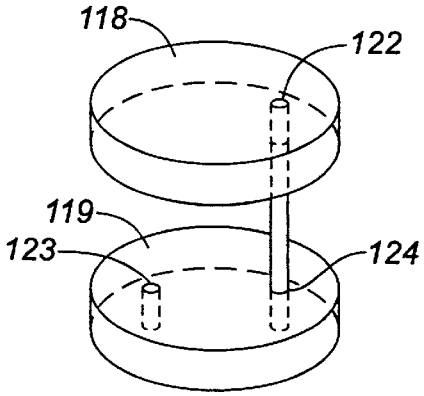

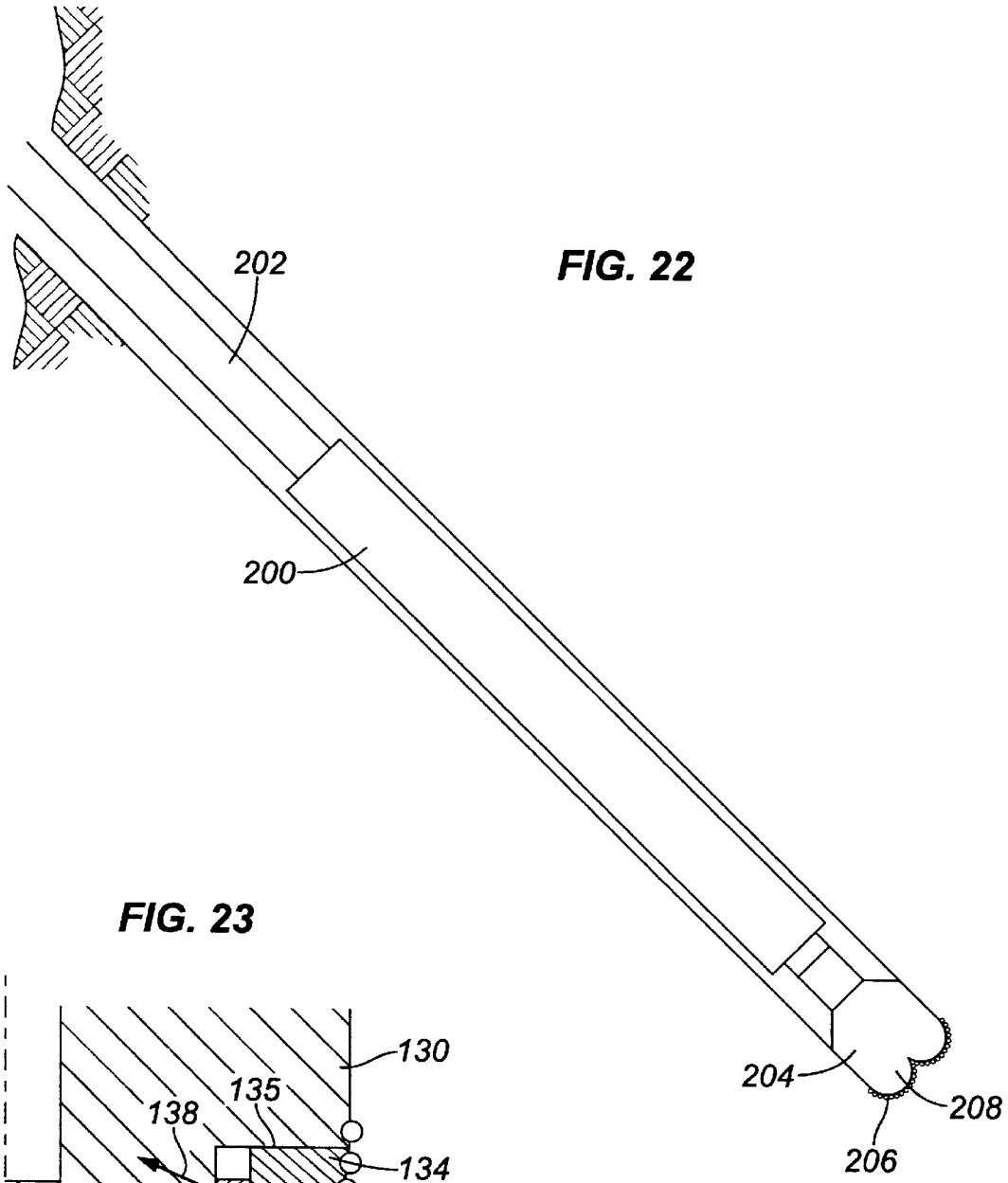
FIG. 22
FIG. 23
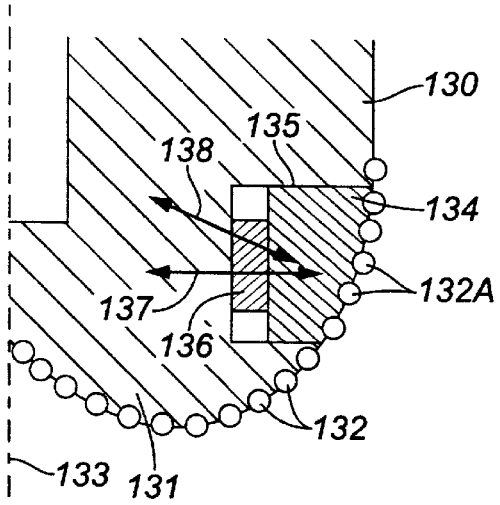

ROTARY DRILL BIT HAVING MOVEABLE FORMATION-ENGAGING MEMBERS

BACKGROUND OF THE INVENTION

1. Field of the Invention

The invention relates to rotary drill bits for use in drilling holes in subsurface formations and, more particularly, to rotary drill bits having moveable formation-engaging members.

2. Background of the Related Art

Drill bits for use in drilling holes in subterranean formations include cutting structures that are positioned at selected locations on a bit body. Typically, each cutting structure includes a thin facing table of superhard material, such as polycrystalline diamond, that is bonded to a substrate of a softer material, such as tungsten carbide. The general construction of bits of this kind is well known and will not be described in detail.

During drilling operations, the cutting structures of such a bit may be subject to impact loads which may cause the cutting elements to crack or fracture. Such impact loads may be generated, for example, when tripping the drill bit into or out of the borehole, or when raising or lowering the drill bit temporarily at the bottom of the borehole. Also, such impact loads may occur when the drill passes through a comparatively soft formation and strikes a significantly harder formation, or when the drill bit encounters hard occlusions within a generally soft formation.

In addition, such drill bits may be subject to instability and vibration. Also such drill bits may be subject to the phenomenon known as "bit whirl," where the bit tends to precess around the borehole in the opposite direction to the direction of rotation of the bit about its axis. Bit whirl may lead to the drilling of an oversize borehole, as well as other difficulties. For example, bit whirl may result in cutting structure momentarily moving in the reverse direction relative to the formation, which can lead to the chipping of the diamond layer on the cutting element. In extreme cases, bit whirl may lead to breakage of all or part of the diamond layer away from its substrate, or even to the separation of the cutting element as a whole from the stud on which it is mounted.

The present invention may address one or more of the problems set forth above.

SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In accordance with one aspect of the present invention, there is provided a rotary drill bit for drilling subsurface formations. The bit includes a bit body and a formation engaging member which is resiliently disposed on the bit body and which is pivotable between a first position and a second position.

In accordance with another aspect of the present invention, there is provided a rotary drill bit for drilling subsurface formations. The drill bit includes a bit body and a plurality of cutting elements disposed on the bit body. At least one of the plurality of cutting elements is disposed within a socket in the bit body. The cutting elements so disposed are moveable between a first position and a second position and are biased into the first position. A retention member is disposed about a periphery of the socket to retain the cutting elements within the socket.

In accordance with still another aspect of the present invention, there is provided a rotary drill bit for drilling subsurface formations. The drill bit includes a bit body and a plurality of blades disposed on the bit body. At least one of the plurality of blades is moveable between an extended position and a retracted position and is biased into the extended position. A plurality of cutting elements is disposed on each of the plurality of blades.

In accordance with yet another aspect of the present invention, there is provided a rotary drill bit for drilling subsurface formations. The drill bit includes a bit body and a plurality of blades disposed on the bit body. A portion of one of the plurality of blades is resiliently mounted on the bit body. A plurality of cutting elements are disposed on each of the plurality of blades.

In accordance with a further aspect of the present invention, there is provided a rotary drill bit for drilling subsurface formations. The drill bit includes a bit body and a plurality of cutting elements disposed on the bit body. At least one active formation engaging element is disposed on the bit body. This formation engaging element is moveable between an extended position and a retracted position. Means are provided for selectively moving the active formation engaging element between the extended position and the retracted position.

In accordance with a still further aspect of the present invention, there is provided a method of directionally drilling a subsurface formation. The method includes the steps of: (a) providing a drill bit having a bit body, a plurality of cutting elements disposed on the bit body, and at least one active formation-engaging element disposed on the bit body, the at least one active formation-engaging element being moveable between an extended position and a retracted position; (b) providing a drill string; (c) coupling the drill bit to the drill string; (d) moving the at least one active formation-engaging element into the extended position during steering of the drill bit; and (e) moving the at least one active formation-engaging element into the retracted position during straight drilling.

In accordance with a yet further aspect of the present invention, there is provided a directional drill string for drilling subsurface formations. The drill string includes a drill bit having a bit body. A plurality of cutting elements are disposed on the bit body. At least one active formation engaging element is disposed on the bit body. The active formation engaging element is moveable between an extended position and a retracted position. A motor is operatively coupled to the drill bit. Tubing is operatively coupled to the motor and to the drill bit. There is provided means for selectively moving the active formation engaging element between the extended position and the retracted position.

BRIEF DESCRIPTION OF THE DRAWINGS

Various advantages of the invention will become apparent upon reading the following detailed description and upon reference to the drawings in which:

FIG. 18 diagrammatically illustrates a cross-sectional view of the structure of FIG. 17, including elements of a control valve system for controlling the formation-engaging structure in a drill bit;

FIG. 19 diagrammatically illustrates an exploded perspective view of the structure of FIG. 17, including elements of a control valve system for controlling the formation-engaging structure in a drill bit;

FIG. 20 diagrammatically illustrates a perspective view of a valve arrangement of the structure of FIG. 17;

FIG. 21 diagrammatically illustrates a perspective view of a valve arrangement of the structure of FIG. 17;

FIG. 22 diagrammatically illustrates a portion of a directional drill string;

FIG. 23 diagrammatically illustrates a portion of one embodiment of a drill bit having a moveable blade portion;

DESCRIPTION OF SPECIFIC EMBODIMENTS

Figure 1:
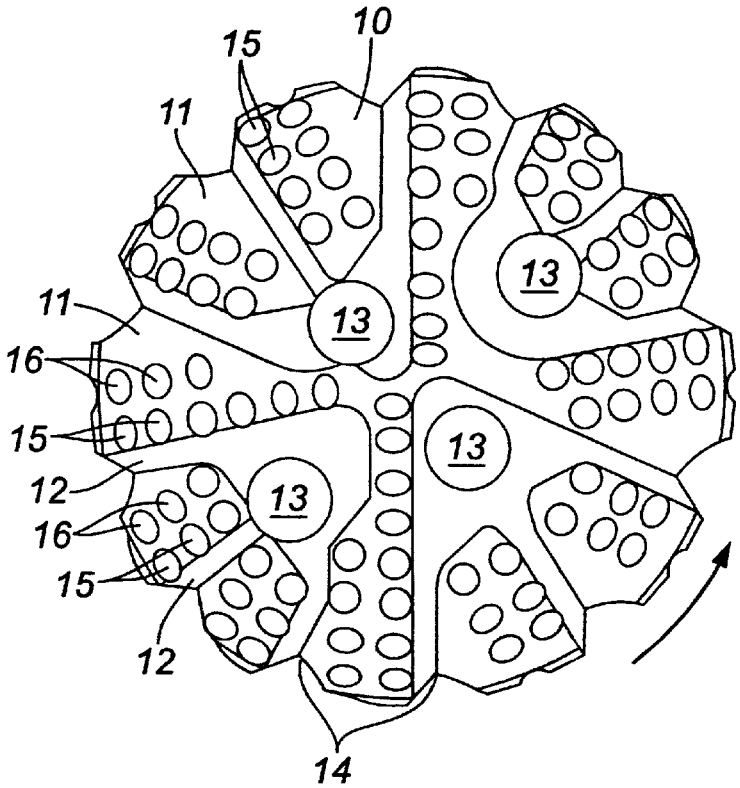
FIG. 1 is a diagrammatic front end view of an example of a polycrystalline diamond compact (PDC) drag-type rotary drill bit.

The rotary drill bit shown diagrammatically in FIG. 1 is of the kind commonly referred to as a PDC (polycrystalline diamond compact) drag-type drill bit. The bit body has a leading end face 10 formed with a number of blades 11. The blades 11 extend from the surface of the bit body to define a plurality of channels 12 between the blades 11. The nozzles 13 are positioned within the channels 12. The nozzles 13 receive drilling fluid from passages (not shown) within the bit body, and the nozzles 13 deliver this drilling fluid to the channels 12. Drilling fluid flowing outwardly along the channels 12 cleans the blades 11 and passes to junk slots 14 in the gauge portion of the bit. The drilling fluid then flows back to the surface through the annulus between the drill string and the surrounding wall of the borehole.

Mounted on each blade 11 is a row of cutting structures 15 (shown diagrammatically). The cutting structures 15 face into the adjacent channels 12 so as to be cooled and cleaned by drilling fluid flowing outwardly along the channels 12 from the nozzles 13 to the junk slots 14. Spaced rearwardly of the three or four outermost cutting structures 15 on each blade 11 are formation-engaging structures 16 (also shown diagrammatically). In the arrangement shown, each formation-engaging structure 16 lies at substantially the same radial distance from the axis of rotation of the bit as its associated cutting structure, although other configurations may be suitable.

Figure 2:
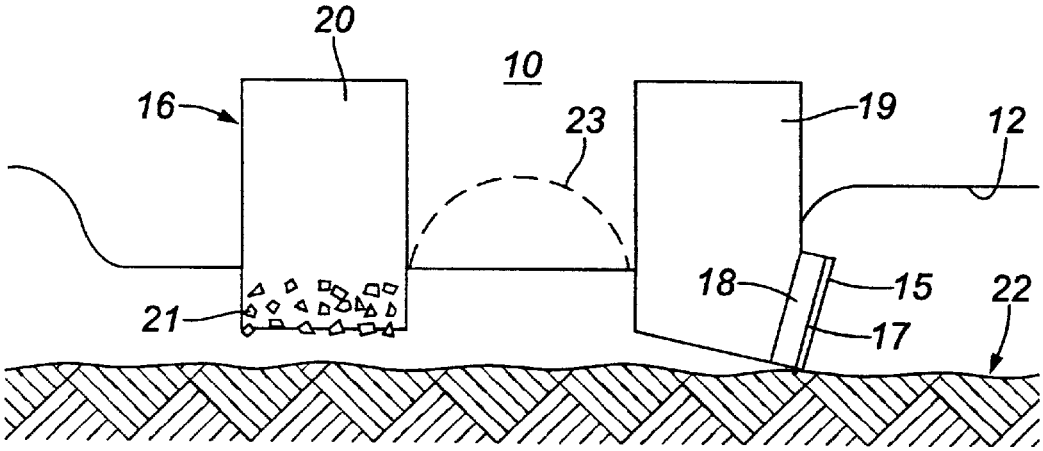
FIG. 2 (Prior Art)
FIG. 2 is a diagrammatic view of a prior art arrangement of a cutting structure and associated formation-engaging element.

FIG. 2 shows a prior art arrangement of cutting structure and associated formation-engaging structure as described in U.S. Pat. No. 4,718,505. In this prior art arrangement, each cutting structure includes a cutting element 15 in the form of a circular preform. The circular preform includes a thin front facing table 17 of a superhard material, such as polycrystalline diamond, bonded to a thicker backing layer 18 of softer material, such as tungsten carbide. The cutting element 15 is bonded, in known manner, to an inclined surface on a generally cylindrical stud 19 which is received in a socket in the bit body 10. For example, the stud 19 may be formed from cemented tungsten carbide, and the bit body 10 may be formed from steel or from solid infiltrated matrix material.

The formation-engaging structure 16 spaced rearwardly of its associated cutting structure includes a generally cylindrical stud 20 which is received in a socket in the bit body 10. The stud 20 may be formed from cemented tungsten carbide impregnated with particles 21 of natural or synthetic diamond or other superhard material. The superhard material may be impregnated throughout the body of the stud 20, or it may be embedded in only the surface portion thereof. Both the cutting element 15 and back-up element 16 are mounted on the same blade 11 on the bit body. To improve the cooling of the cutting element and back-up element, another channel for drilling fluid may be provided between the two rows of elements as indicated at 23 in FIG. 2.

The formation-engaging structure 16 may be so positioned with respect to the leading surface of the drill bit that it does not come into cutting or abrading contact with the formation 22 until a certain level of wear of the cutting element 15 is reached. Alternatively, it may be initially at the same level as the cutting element. With such an arrangement, during normal operation of the drill bit, the major portion of the cutting or abrading action of the bit is performed by the cutting elements 15. However, should a cutting element wear rapidly or fracture so as to be rendered ineffective, for example by striking hard formation, the formation-engaging structure 16 takes over the abrading action of the cutting element thus permitting continued use of the drill bit. Provided the cutting element 15 has not fractured or failed completely, it may resume some cutting or abrading action when the drill bit passes once more into softer formation.

In the prior art arrangement shown in FIG. 2, both the cutting structure and formation-engaging structure 16 are rigidly mounted on the bit body. Since the cutting element 15 projects further from the bit body than the back-up element 16, the back-up element provides only comparatively limited protection for the cutting element against damage caused by impact of the cutting element on the formation. If the rigid back-up structure 16 were to extend from the bit body to the same extent, or even to a greater extent, than the cutting element, this would provide greater protection for the cutting element against impact damage, but it may also interfere with the efficient cutting action of the cutting element.

Arrangements where cutters and back-up elements are rigidly mounted on the bit body also exhibit other disadvantages. For instance, situations may occur where some of the formation-engaging structures, whether cutters or back-up elements, do not all engage the surrounding formation during drilling. Such a situation may arise, for example, because of wear or damage to the cutters or because of differences in the local nature of the formation. This situation can lead to bit instability and vibration, and it can also lead to bit whirl.

Figure 3:
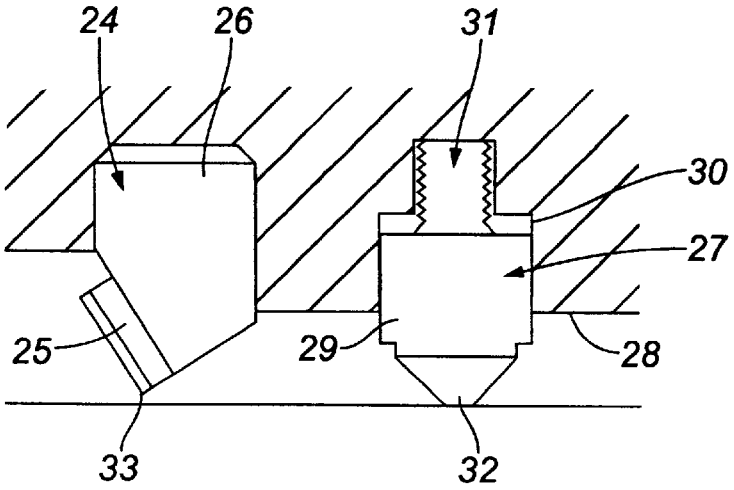
FIG. 3 is a diagrammatic view of an arrangement of a cutting structure and associated formation-engaging element in accordance with the present invention.

To address these concerns, a drill bit may be provided with formation-engaging structures that are not rigidly mounted on the bit body. Instead, such structures are "active" and may move inwardly and outwardly with respect to the bit body. One such arrangement is illustrated in FIG. 3. Similar to the prior art arrangement of FIG. 2, the cutting structure 24 includes a polycrystalline diamond compact cutting element 25 bonded to a tungsten carbide post 26. A back-up formation-engaging structure 27 is spaced rearwardly of the cutting structure 24. As shown in FIG. 3, the structure 27 may be on the same blade 28 on the bit body as the cutter 24 and at substantially the same radial distance from the central axis of rotation of the drill bit. However, this is not essential, and the formation-engaging structure may be on a different blade and/or at a different radial distance from the bit axis.

As illustrated in FIG. 3, the back-up structure 27 is an active structure. It includes a generally cylindrical formation-engaging element 29 which is slidable inwardly and outwardly in a corresponding cylindrical socket 30 in the bit body. Inward movement of the element 29 is opposed by a resiliently flexible compression element 31. The element 31 may be a mechanical compression spring, an elastomeric insert, a compressed gas bellows, a fluid pressure system, or any other suitable arrangement which will resiliently oppose at least the inward movement of the formation-engaging element 29.

The element 29 may include a simple stud of hard material such as cemented tungsten carbide, a stud impregnated with natural or synthetic diamond or other superhard material, or it may be provided at its outermost surface with a single block or layer of polycrystalline diamond or other superhard material. In the arrangement shown, the outer extremity of the element 29 is generally frusto-conical in shape, as indicated at 32, but it may be of any other suitable shape. For example, it may be domed, formed with a shallow convex curve, or substantially flat.

Means, not shown in FIG. 3, are provided to retain the element 29 in the socket 30. For example, the element may be anchored by the resiliently flexible arrangement 31, or mechanical inter-engaging formations may be provided on the element 29 and socket 30 to limit the outward movement of the element.

At its outermost limit of movement, the outermost portion of the element 29 projects from the surface of the blade 28 by a greater amount than the cutting edge 33 of the cutting element 25. It may be urged inwardly to such an extent that it lies inwards of the cutting edge 33. Typically, the element 29 may be arranged to move outwardly from a position 2.0 mm inwardly of the cutting edge 33 to a point 2 mm outwardly of the cutting edge. As a consequence, the element 29 will automatically be urged outwardly until it contacts the formation, regardless of the condition of its associated cutting element 25. The back-up element 29 will therefore provide at least some protection to the cutting element 25 against impact damage because the element 29 will absorb some of any load imparted to the cutting element. At the same time, since the back-up element 29 is usually in contact with the surrounding wall of the borehole, it may enhance the stability of the drill bit in the borehole and tend to inhibit the initiation of bit whirl.

Figure 4:
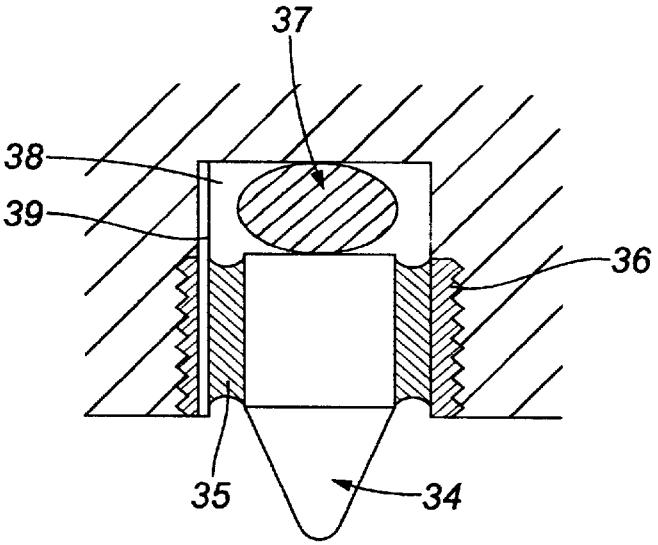
FIG. 4 illustrates a diagrammatic section of an alternate embodiment of a formation-engaging structure in accordance with the present invention.
Figure 5:
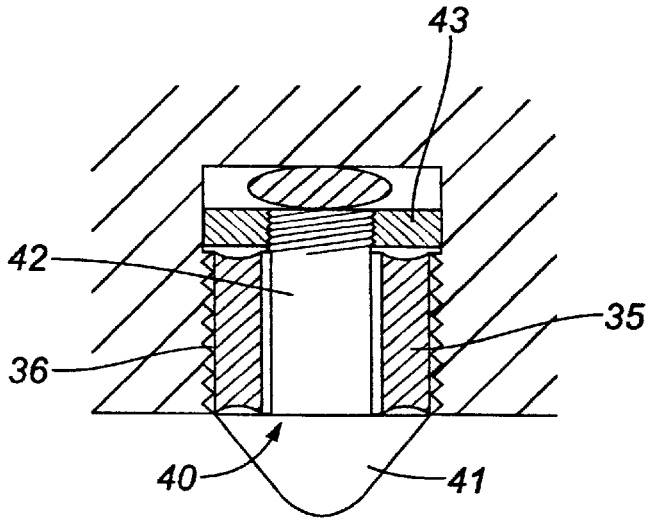
FIG. 5 illustrates a diagrammatic section of another alternate embodiment of a formation-engaging structure in accordance with the present invention.
Figure 6:
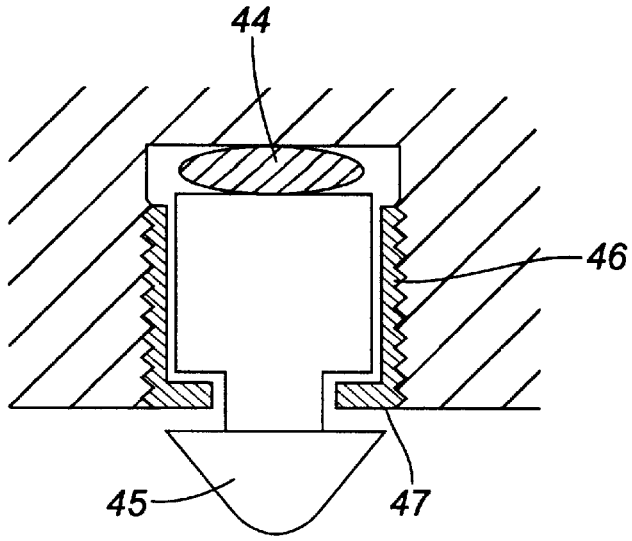
FIG. 6 illustrates a diagrammatic section of another alternate embodiment of a formation-engaging structure in accordance with the present invention.

FIGS. 4–6 show further forms of formation-engaging elements which are capable of outward and inward movement relative to the bit body. In the arrangements of FIGS. 4–6 the formation-engaging elements 34, 40 and 45 may take any desired form and may be of any of the kinds referred to in relation to FIG. 3.

In the arrangement of FIG. 4, the formation-engaging element 34 is received within a cylindrical socket 35 in the bit body. The element is bonded to a surrounding annular sleeve 35 of rubber or other elastomer. The sleeve 35 is bonded to a cylindrical metal sleeve 36 that is screwed into the outer part of the socket 35. A ball 37 of rubber or other elastomer may be disposed, under compression, between the element 34 and the bottom wall of the socket 35. The area surrounding the ball 37 may be packed with grease 38. A vent channel 39 is provided in the wall of the socket 35 and sleeve 36 to allow grease to move in and out of the bottom of the socket as the element 34 moves in and out of the socket.

Instead of the area surrounding the ball 37 being filled with grease, it may be supplied with drilling fluid under pressure from the central passage in the bit, for example at a pressure drop of 500 to 2000 psi. Such an arrangement has the advantage that the area surrounding the ball 37 is then only pressurised by the drilling fluid when drilling fluid is being pumped downhole, such as is the case while drilling is actually taking place. Generally drilling fluid is not pumped while the drill bit is being tripped into or out of the borehole. Consequently, the element 34 is at its most inward position during such tripping to facilitate this.

FIG. 5 shows a modified version of the arrangement of FIG. 4 where the formation-engaging element 40 includes a head 41 and a spindle 42. An annular disc 43 is screwed onto the inner end of the spindle 42. The enlarged head 41 limits the inward movement of the element 40 while the disc 43 limits the outward movement of the element 40, both as a result of engagement with the ends of the sleeve 36. The enlarged head 41 also serves to protect the rubber shear element 35 from the various environmental conditions, except for the prevailing temperature.

In the arrangement of FIG. 6, the annular shear device 35 is omitted. Instead, the body of elastomer 44 provides the sole means for urging the formation-engaging element 45 outwardly, the main body of the element 45 being slidable in the surrounding sleeve 46. In this case, an inwardly projecting annular flange 47 at the outer extremity of the sleeve 46 engages an annular rebate in the element 45 to limit the inward and outward movement of the element.

In the arrangements of FIGS. 3–6, the formation-engaging element is capable of translational inward and outward movement relative to the bit body. In the arrangements of FIGS. 7–10, however, the inward and outward movement of the outer part of the formation-engaging element is effected by tilting of the element relative to the bit body.

Figure 7:
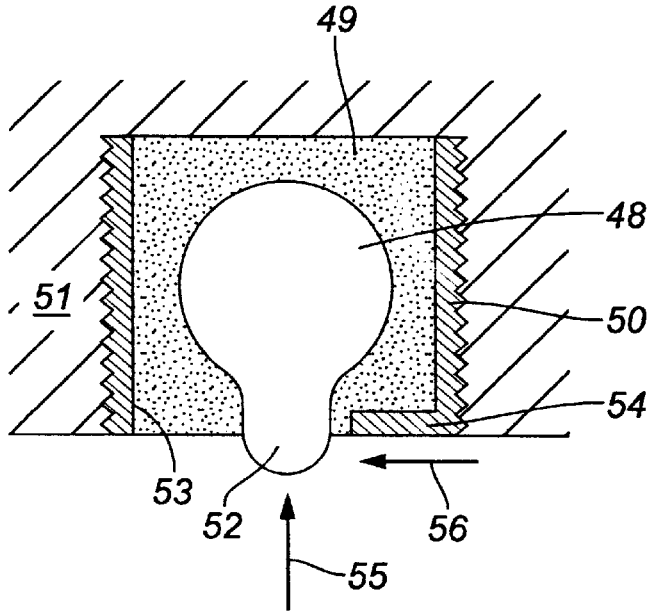
FIG. 7 illustrates a diagrammatic section of another alternate embodiment of a formation-engaging structure in accordance with the present invention.
Figure 8:
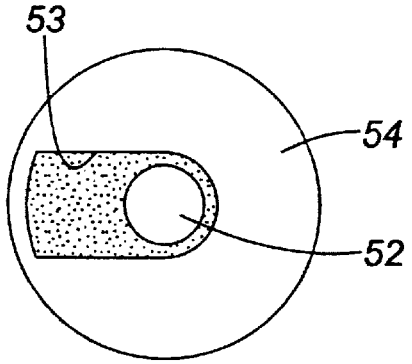
FIG. 8 illustrates an end view of the formation-engaging structure of FIG. 7.

In the arrangement of FIG. 7, a generally pear-shaped formation-engaging element 48 is bonded into a body of rubber 49 contained within a tubular sleeve 50. The sleeve 50 is screwed into a threaded socket in the bit body 51. The smaller outer part 52 of the element 48 projects from the body of rubber 49 and projects through an elongate asymmetric aperture 53 in an outer end face 54 of the sleeve 50. The sleeve 50 may be drilled and pinned to prevent rotation of the sleeve relative to the bit body after it has been fitted.

The rubber 49 advantageously may be made of solid rubber rather than foamed rubber. Since the rubber is substantially fully confined within the sleeve 50, constancy of volume substantially prevails and the rubber does not behave significantly as an elastomer. Accordingly, the mounting of the element 48 offers an effectively solid resistance to impact at right angles to the surface of the bit body, as indicated by the arrow 55. However, when struck by a force having a component rearwardly with respect to the direction of movement of the element, as indicated by the arrow 56, the element 48 will tilt within the sleeve 50. Such tilting is resiliently resisted by the rubber 49. The rearward tilting of the element reduces the extent to which the outer portion 52 of the element projects above the surface of the bit body. The element 48 may take any of the forms previously described.

It will be appreciated that translational inward movement of the element 48 against the resilience of the rubber 49 may only be achieved as a result of slight extrusion of the rubber through the orifice 53. Consequently, the effective stiffness of the rubber in the direction of the axis of the element may be increased by reducing the size of the orifice 53 or it may be reduced by increasing the size of the orifice 53.

Figure 9:
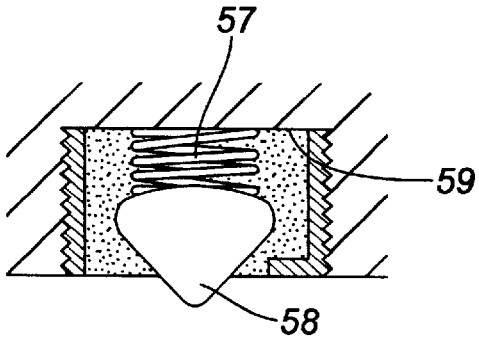
FIG. 9 illustrates a diagrammatic section of another alternate embodiment of a formation-engaging structure in accordance with the present invention.

Another way of controlling the stiffness of the resilience to inward axial movement of the element is shown in FIG. 9. As illustrated, a helical compression spring 57 is disposed between the inner end of the element 58 and the bottom wall 59 of the socket in which the structure is located.

Figure 10:
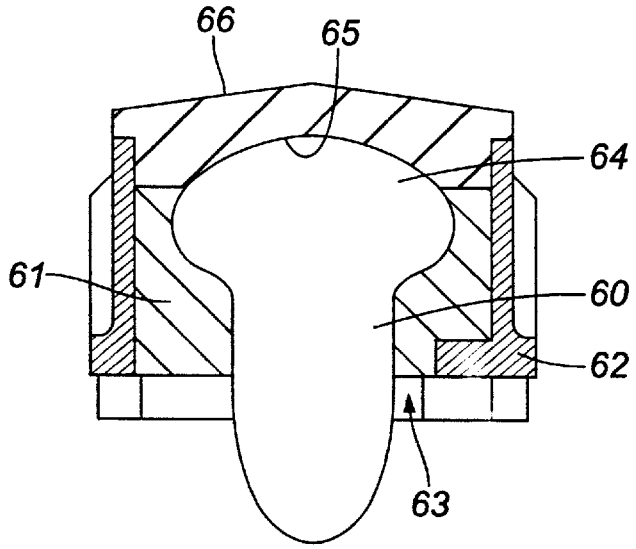
FIG. 10 illustrates a diagrammatic section of another alternate embodiment of a formation-engaging structure in accordance with the present invention.

FIG. 10 shows a further embodiment where the formation-engaging element operates in similar fashion to the elements of FIGS. 7 and 9. In this arrangement, the generally T-shaped element 60 is bonded into a surrounding body of soft rubber 61 within a metal sleeve 62. The narrow outer end of the element 60 projects through an aperture 63 in the outer end face of the sleeve 62. The part spherical inner end 64 of the element slides in a lubricated part-spherical depression 65 in an insert 66 of harder rubber or other material which fits within the bottom of the socket in the bit body in which the assembly is received. As in the previous arrangements, the body of soft rubber 61 provides the spring energy to urge the formation-engaging element 60 to its neutral position, as shown in FIG. 10, so that the element tilts against the resilient restraint of the soft rubber in response to forces having a component in the drilling direction. The hard rubber body 66 provides a high spring rate in axial compression to act as a shock absorber in respect of force components at right angles to the surface of the bit body. The element 60 is shown as having a layer 68 of polycrystalline diamond on the outer surface thereof which bears against the formation. However, the construction of the element 60 may be any of the other kinds previously discussed.

As well as providing shock absorbency and stability of the drill bit, the tilting element arrangements of FIGS. 7–10 may also limit damage to an associated cutting structure as a result of temporary reversal of the direction of rotation of the drill bit. In its neutral position, each tilting element will normally be dimensioned so that it projects a short distance further from the bit body than the cutting edge of its associated cutting structure. During normal drilling operation, the forward rotation of each cutter and tilting back-up element will cause the back-up element to tilt backwardly until the cutting edge of its associated cutter contacts the formation. Drilling will continue with the outer extremity of the back-up element automatically on the same profile as the cutting edge of its associated cutter. However, should temporary reversal of the direction of rotation of the drill bit occur, the force acting on the tilting back-up element will be reversed causing the element to tilt back to its neutral position. Since in this position its outer extremity projects further from the bit body than the cutting edge of the associated cutter, this return movement of the element will have the effect of pushing the associated cutter away from the formation, thus preventing the damage to the cutter which might otherwise occur as a result of the cutter temporarily moving backwards against the formation.

Figure 11:
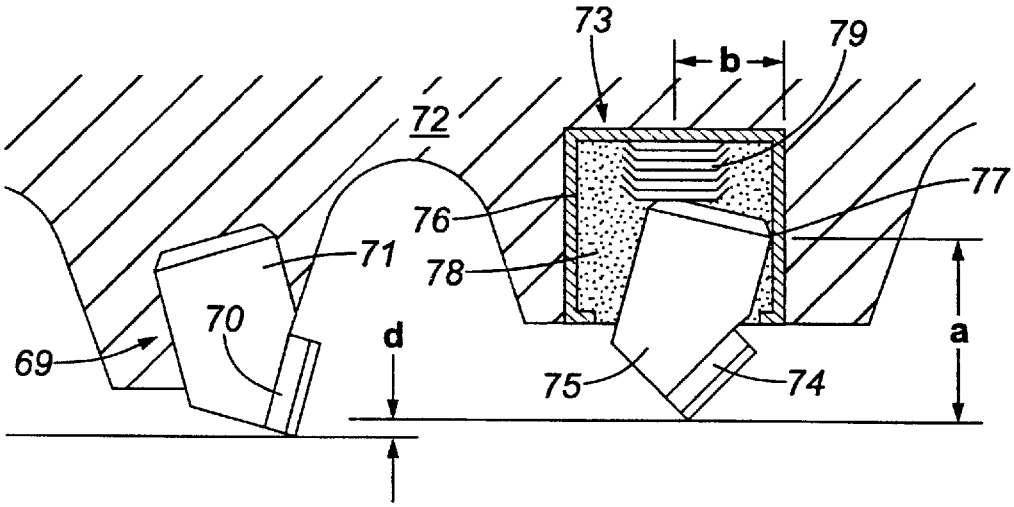
FIG. 11 is a sectional view of an arrangement where the formation-engaging structure acts as a cutting structure.
Figure 12:
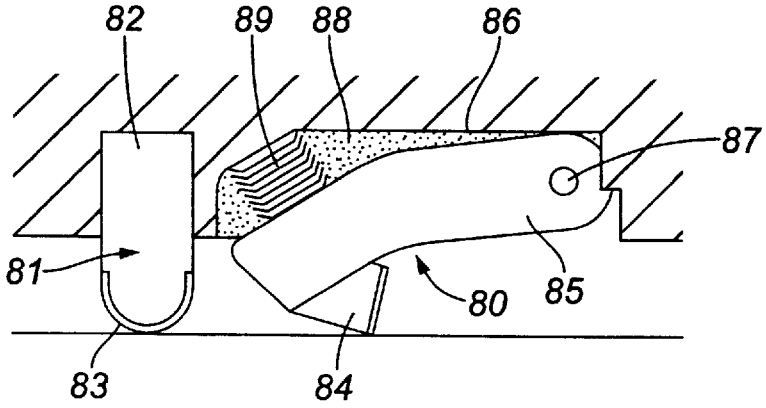
FIG. 12 is a sectional view of a further arrangement where the formation-engaging structure acts as a cutting structure.

In the previously described arrangements, the active formation-engaging structure has been described as an abrading element or as a bearing element which simply bears against the surface of the formation without having any significant abrading effect on it. However, as previously mentioned, arrangements where the active formation-engaging structure is a cutting structure that actually removes chips or cuttings from the formation during drilling may also be used. FIGS. 11 and 12 illustrate two such arrangements.

In FIG. 11, a primary cutting structure 69 includes a circular polycrystalline diamond compact 70 bonded to a post 71. The post 71 is received in a socket in the blade 72 on the bit body. In this case, the associated formation-engaging structure 73 also includes a polycrystalline diamond cutting element 74 bonded to a post 75. The structure 73 is located on the leading side of the cutter 69 in the direction of rotation, and it is at substantially the same radius from the central longitudinal axis of rotation of the drill bit.

The cutter 74, 75 is located within a cylindrical cup 76 received in a socket in the bit body. The cutter post 75 is formed on its forward side with a ridge 77 which bears against the wall of the cup 76 to provide a fulcrum for pivoting of the cutter in the cup. The post 75 of the cutter is held within the cup 76. Specifically, the post 75 is bonded within a body 78 of rubber disposed between a surface on the post 75 and the bottom of the cup 76. A stack of belville springs 79 may also be bonded within the body 78 of rubber.

The arrangement of the cutter 74, 75 is such that, in its neutral position, its cutting edge is nearer the bit body than the cutting edge of the cutter 69 by a distance "d". The fulcrum provided by the ridge 77 on the cutter 74, 75 is a distance "a" in the neutral position, and the horizontal distance of the cutting edge from the fulcrum is indicated at "b".

In this arrangement, the cutting structure 69 is the primary cutting structure for removing formation from the borehole. The subsidiary cutting structure 73, however, acts as a penetration limiter as follows. The distance "d" is a predetermined desired depth of cut. If this depth of cut is exceeded, the drag $F_d$ acting on the cutter 74, 75 will increase causing the cutter 74, 75 to tilt rearwardly within its housing. This will increase the vertical force $F_{wob}$ acting on the cutting structure 73 where $F_{wob}=F_d \times a/b$. This force reduces the effective weight-on-bit acting on the primary cutter 69, thus reducing the depth of cut.

In the arrangement of FIG. 12, an active primary cutting structure 80 is provided followed by a conventional static back-up formation-engaging element 81. In this instance, the element 81 includes a tungsten carbide post 82 having a domed head capped with a layer 83 of polycrystalline diamond. The active cutting structure 80 includes a polycrystalline diamond compact cutting element 84 mounted on one end of an arm 85. The arm 85 partly extends into a socket 86 in the bit body where the end of the arm remote from the cutter 84 is pivotally mounted on a self-locking hinge pin 87. Inwardly of the arm 85, a body 88 of rubber or other elastomer is disposed in the socket 86. Belville springs 89 may be embedded in the body 88 to act on the inner surface of the arm 85.

During normal drilling, the cutter 84 is urged into contact with the formation by the combination of the rubber 88 and springs 89 thus tending to stabilize the bit in the borehole. However, if the cutter is subjected to impact loads, for example by impact of the drill bit on the bottom of the hole, the rubber and springs yield allowing the cutter to pivot inwardly towards the bit body so that the majority of the impact is absorbed by the back-up element 81.

It should also be mentioned that the various arrangements for resiliently supporting individual formation-engaging elements illustrated in FIGS. 3–12 may also be used for resiliently supporting an entire blade 11 or a portion of a blade 11. For example, as illustrated in FIG. 1, a blade 11 may contain a row of cutting elements 15 followed by a row of back-up elements 16. Hence, the front portion of a blade 11 which carries the cutting elements 15 may be resiliently supported using arrangements similar to those disclosed in FIGS. 3–12, while the rear portion of the blade 11 which carries the back-up elements 16 may be rigidly affixed to the bit body. Alternatively, the front portion of a blade 11 which carries the cutting elements 15 may be rigidly affixed to the bit body, while the rear portion of the blade which carries the back-up elements 16 may be resiliently supported using arrangements similar to those disclosed in FIGS. 3–12. Other arrangements may also be advantageous. For example, one or more entire blades 11 may be resiliently supported using arrangements similar to those disclosed in FIGS. 3–12, while other blades 11 are rigidly affixed to the bit body.

Figure 13:
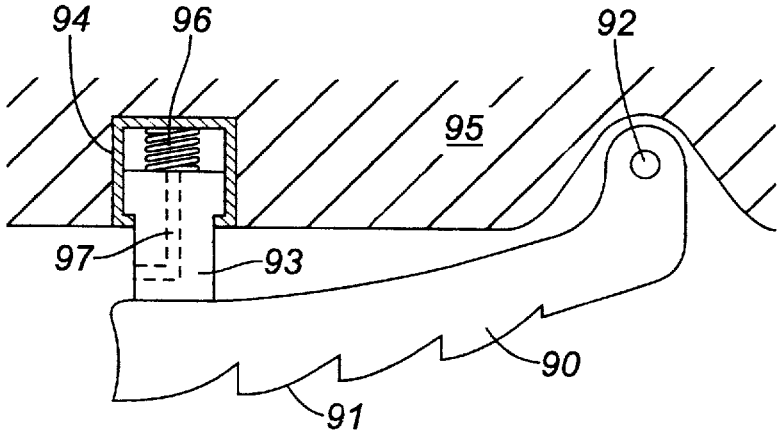
FIG. 13 illustrates a diagrammatic sectional view of an arrangement where the formation-engaging structure is pivotally mounted on the bit body.
Figure 14:
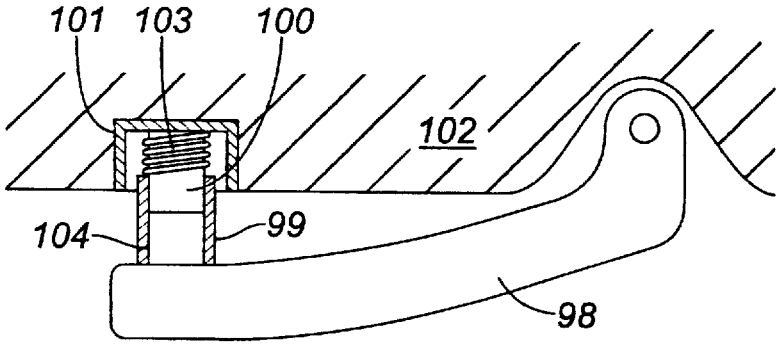
FIG. 14 illustrates a diagrammatic sectional view of another arrangement where the formation-engaging structure is pivotally mounted on the bit body.
Figure 15:
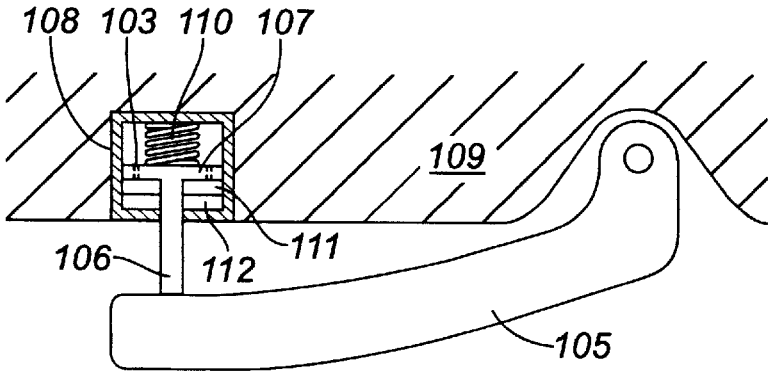
FIG. 15 illustrates a diagrammatic sectional view of another arrangement where the formation-engaging structure is pivotally mounted on the bit body.

FIGS. 13–15 illustrate further alternative arrangements where the formation-engaging structure includes a pivotally mounted arm which may pivot towards and away from the bit body. In the arrangement of FIG. 13, an arm 90 having a ridged outer surface 91 is pivotally mounted at 92 on the bit body. The end of the arm 90 remote from the pivot 92 is engaged by a sliding thrust member 93 which is slidable within a cylindrical socket element 94 mounted in the bit body 95. A helical compression spring 96, or other form of resiliently flexible device, is located between the inner surface of the thrust member 93 and the bottom of the socket 94 so as to urge the thrust member 93, and hence the arm 90, outwardly. A vent passage 97 is provided in the thrust member 93 to allow air or other fluid to pass into and out of the socket 94 as the thrust member 93 moves.

During drilling, the pivot arm 90 is urged resiliently against the surrounding wall of the borehole, thus tending to stabilise the drill bit and prevent vibration. The device may also inhibit reverse rotation of the drill bit. Upon such rotation being initiated, the ridged outer surface of the arm 90 will engage the formation. This tends to cause the arm to pivot further outwardly into engagement with the formation, thus inhibiting the reverse rotation. The arrangement may thus inhibit bit whirl.

In the modified arrangement of FIG. 14, the rearward end of the pivoted arm 98 is formed with a tubular member 99 which slides over a projection 100 located in a socket 101 in the bit body 102. A helical compression spring 103 is disposed between the end of the tube 99 and the bottom of the socket 21 to urge the pivot arm 98 outwardly. A vent hole 104 is provided in the wall of the tube 99 for the inward and outward flow of air or liquid.

In the further modified arrangement of FIG. 15, the pivot arm 105 is engaged by a thrust member 106 on a piston 107 which is slidable in a hollow cylinder 108 mounted in the bit body 109. A helical compression spring 110 is located between the piston 107. The inner end of the cylinder 108 and the interior of the cylinder is filled with a suitable fluid 111 and a gas 112. The spring 110 urges the piston and hence the pivoted arm 105 outwardly until the outer surface of the arm 105 contacts the formation of the borehole. The piston 107 is formed with transfer passages 113 which permit the fluid in the cylinder to pass through the piston as it moves inwardly and outwardly. In a modification of this arrangement, the interior of the cylinder 108 may be filled with a thixotropic liquid.

In any of the arrangements of FIGS. 13–15, the pivoted formation-engaging member may be located on the gauge portion of the drill bit with the pivot axis of the pivot arm extending generally longitudinally of the drill bit. There may be provided a series of such pivoted members disposed side-by-side around substantially the whole of the gauge of the drill bit to provide a substantially continuous active gauge for the bit.

As mentioned in relation to the above described arrangements, the apparatus for resiliently urging the fluid-engaging member outwardly may include an arrangement for supplying fluid, such as drilling fluid, under pressure to the inner side of the moveable member. Such an arrangement is shown diagrammatically in FIG. 17 where a domed formation-engaging insert 114 is slidable in fluid-tight fashion in a bore 115 in the bit body 116. The inner face of the member 114 faces into a chamber 117 in the bit body to which may be delivered fluid under pressure. For example, as previously described, drilling fluid under pressure may be fed to the chamber 117 from the internal passage in the drill bit through which drilling fluid is pumped under pressure to the surface of the bit. An arrangement of the kind shown in FIG. 17 may be employed where it is desirable for the thrust exerted on the formation by the active formation-engaging members to be dependent on the torque to which the bit is subjected during drilling.

When a PDC bit is run on a motor, particularly when steering is taking place, there may often be a problem with stalling of the motor. When orienting the bit during steering, the operator prefers the bit to be unaggressive, so that momentary increase in the bit torque does not stall the motor or cause the tool face to be lost. Once the borehole is heading in the desired direction, however, the operator will want to maximise rate of penetration, but again without stalling the motor.

Figure 16:
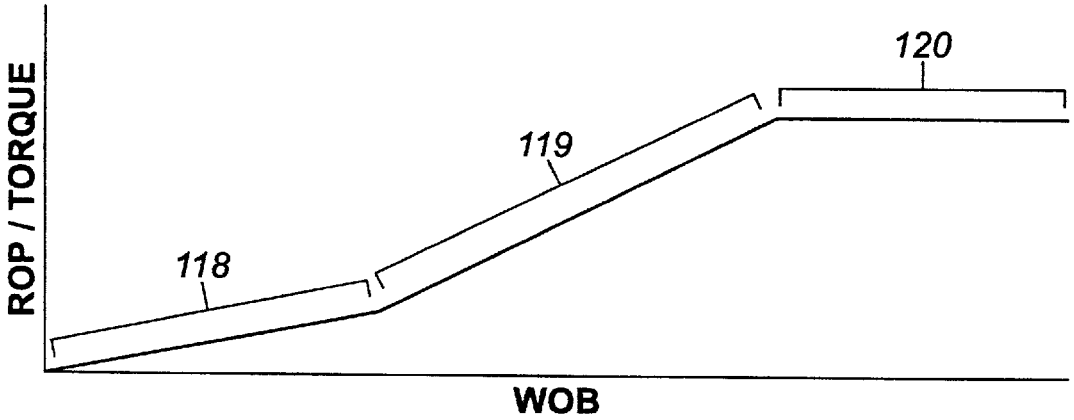
FIG. 16 is a graph of rate of penetration of a drill bit against weight-on-bit showing a desired relationship.

This desired manner of operation is illustrated by the graph of FIG. 16 which shows rate of penetration or torque against weight-on-bit. A comparatively low weight-on-bit is indicated by the portion 118 of the graph. In the portion 118, orienting or steering of the bit may take place. Thus, a low rate of penetration is preferred, equivalent to having a very unaggressive bit. When the weight-on-bit is in a normal operating range, however, a comparatively higher rate of penetration is typically preferred. The normal range of operation of a conventional PDC bit is indicated by the portion of the graph 119, where an aggressive bit is usually preferred. At a high weight-on-bit, it is desirable to limit rate of penetration and torque, as indicated by the portion 120 of the graph, to prevent stalling of the motor. The portion 120 therefore corresponds to an unaggressive bit.

To design a bit to perform as shown in the graph of FIG. 16, the formation-engaging members on the bit may be controlled so that the bit is unaggressive at low weight-on-bit, and torque limited at high rates of penetration, with an operating range in between. Alternatively, the aggressitivity of the bit may be limited, such that at a specified torque or weight-on-bit, the bit becomes very unaggressive.

Figure 17:
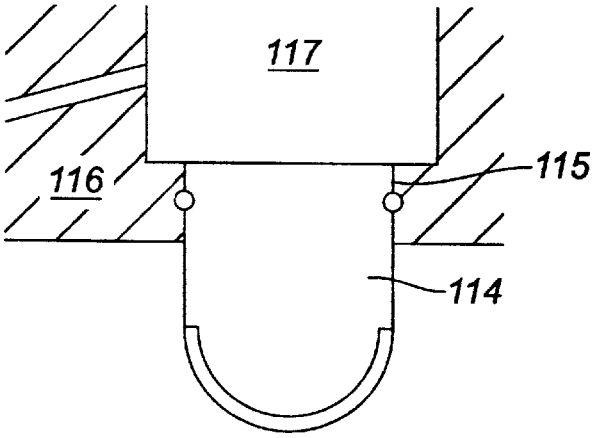
FIG. 17 is a diagrammatic section through a formation-engaging structure which may be employed on a drill bit to achieve the desired characteristics shown in FIG. 16.

This effect can be achieved by using an active formation-engaging member, for example of the kind shown in FIG. 17, with suitable control of the supply of drilling fluid under pressure to the member. The supply of fluid to the chamber 117 is under the control of a disc valve assembly of the kind shown diagrammatically in FIGS. 20 and 21. The disc valve includes an upper disc 118 which is connected to the shank of the drill bit. The upper disc 118 cooperates with a lower disc 119 which is mounted on the crown of the drill bit. The crown of the drill bit is capable of limited rotation relative to the pin, as will be described. As shown diagrammatically in FIGS. 18 and 19, the shank 120 and crown 121 of the bit are connected by a bayonet-type connection so that weight-on-bit and overpull may be transferred from one part to the other. Radial projections 125 on the lower end of the shank 120 engage within L-shaped recesses 126 in the crown 121. Pads 127 of elastomer are located in the crown 121 to resist relative rotation between the crown 121 and shank 120. The extent of such relative rotation is thus indicative of the torque to which the bit is subjected in use.

Referring again to FIGS. 20 and 21, the upper disc 118 has a single aperture 122, and the lower disc has two circumferentially spaced apertures 123 and 124. When the aperture 122 is in register with either of the apertures 123 or 124, drilling fluid under pressure is delivered to the chambers 117 of a number of active formation-engaging members 114 on the bit body. The drilling fluid extends those members into engagement with the formation, thus tending to negate the cutting effect of the associated cutters and thereby render the drill bit unaggressive. When the aperture 122 is out of register with both of the apertures 123 and 124, no fluid under pressure is delivered to the chambers 117 so that the formation-engaging members 114 are retracted. Thus, the cutters on the bit may be fully effective to render the drill bit aggressive for normal drilling operations.

The arrangement is such that the aperture 122 is in register with the aperture 123 at a particular low torque and comes into register with the aperture 124 at a particular predetermined high torque. Low torque actuation is achieved by using a torsional preload in the pads of elastomer 127. At zero torque the aperture 122 is out of register with the aperture 123. However, at a first predetermined low torque, the aperture 122 is brought into register with the aperture 123, which results in predetermined relative rotation between the bit body and the pin. As the torque increases into the operating range, the aperture 122 moves out of register with either of the apertures 123 and 124, and the formation-engaging members 114 retract and drilling proceeds normally. If torque suddenly rises, the resultant relative rotation between the bit body and pin against the action of the elastomer bodies 120 causes the aperture 122 to rotate into register with the aperture 124. Thus, the formation-engaging members 114 are again extended to render the bit unaggressive and, thus, reduce the torque and prevent the motor from stalling. If it is desired only to limit the high torque to which the bit is subjected, the aperture 123 may be omitted.

It should also be mentioned that the similar valve arrangements may also be used for controlling the position of an entire blade 11 or a portion of a blade 11. As illustrated in FIG. 1, a blade 11 may contain a row of cutting elements 15 followed by a row of back-up elements 16. Hence, the front portion of a blade 11 which carries the cutting elements 15 may be moveable using fluid pressure by arrangements similar to those disclosed in FIGS. 17–21, while the rear portion of the blade 11 which carries the back-up elements 16 may be rigidly affixed to the bit body. Alternatively, the front portion of a blade 11 which carries the cutting elements 15 may be rigidly affixed to the bit body, while the rear portion of the blade which carries the back-up elements 16 may moveable using fluid pressure by arrangements similar to those disclosed in FIGS. 17–21. Other arrangements may also be advantageous. For example, one or more entire blades 11 may be moveable using fluid pressure by arrangements similar to those disclosed in FIGS. 17–21, while other blades 11 are rigidly affixed to the bit body.

Such an ability to reconfigure the drill bit is particularly useful during steering operations carried out with the drill bit being directly coupled to a downhole motor 200, as illustrated in FIG. 22. The tubing 202 that is coupled to the motor 200 provides the drilling fluid to the drill bit 204 to alter the positions of the formation engaging elements 206, blades 208, or portions of blades 208 as described above.

FIGS. 23–27 show arrangements, of the kind previously referred to, where the formation-engaging member on a drill bit includes a blade, or a portion of a blade, on which a plurality of cutters are mounted.

In drag-type rotary drill bits, it is usually those cutters which are furthest from the central axis of rotation of the bit which generate the majority of the torque. To avoid excessive generation of torque, therefore, it would be advantageous for at least some outer cutters to move inwardly away from the formation to reduce the torque when a predetermined level of torque is reached. FIGS. 23–27 show, by way of example, arrangements whereby this may be achieved.

In the arrangement of FIG. 23, the bit body 130 has a number of upstanding blades 131 extending outwardly away from the central axis of rotation 133 of the bit. Cutters 132 are mounted along each blade. A portion 134 of each blade 131 is slidably received in a socket 135 in the bit body. A biasing device indicated diagrammatically at 136, is located in the socket 135 to urge the blade portion 134, and the cutters 132A which it carries, outwardly toward the surface of the formation being drilled. The biasing device 136 may be an elastomeric member, a compression spring or other spring means, a compressed gas bellows, a fluid pressure system, or any other suitable biasing arrangement.

The outward biasing force imposed on the blade portion 134 by the device 136 is such that the resistance provided by the biasing device is overcome when a predetermined torque is generated. If such torque is generated, the blade portion 134, with the cutters 132A, then moves inwardly away from the formation, thereby tending to reduce the torque.

Figure 24:
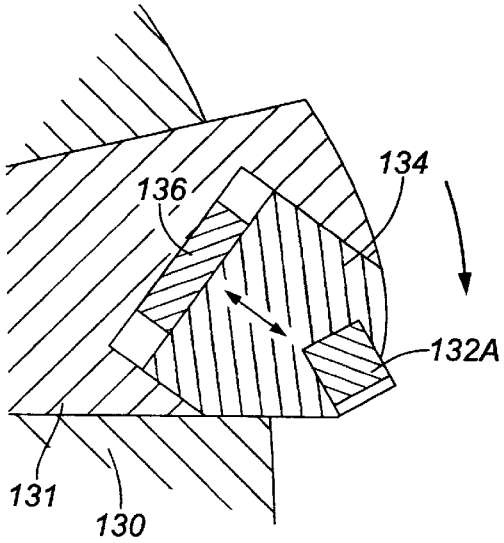
FIG. 24 diagrammatically illustrates a portion of a second embodiment of a drill bit having a moveable blade portion.

The blade portion 134 and socket 135 may be arranged generally radially of the drill bit and at right angles to the bit axis 133, as shown in FIG. 23, so that the blade portion 134 moves directly toward and away from the bit axis as indicated by the arrow 137. Alternatively, however, the axis of the slot 135 may be inclined at an angle to the bit axis 133 so that, for example, the blade portion moves towards and away from the bit axis along the line indicated by the arrow 138. Alternatively, or in addition, the direction of displacement of the blade portion 134 may be at an angle to a radius of the drill bit, as shown in FIG. 24.

Figure 25:
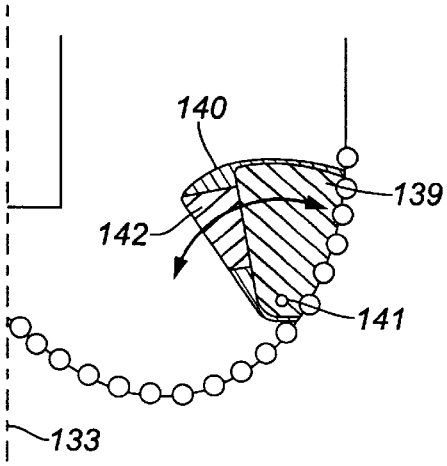
FIG. 25 diagrammatically illustrates a portion of a third embodiment of a drill bit having a moveable blade portion.

In the alternative arrangement shown in FIG. 25, the blade part 139, instead of being slidable in a slot in the bit body, is disposed in a recess 140 and is arranged to pivot about a pivot axis 141 which extends perpendicular to the bit axis 133. Again, a biasing device, diagrammatically indicated at 142, is located in the recess 140 to bias the blade portion 139 outwardly. The biasing device 142 may be of any of the kinds mentioned previously.

Figure 26:
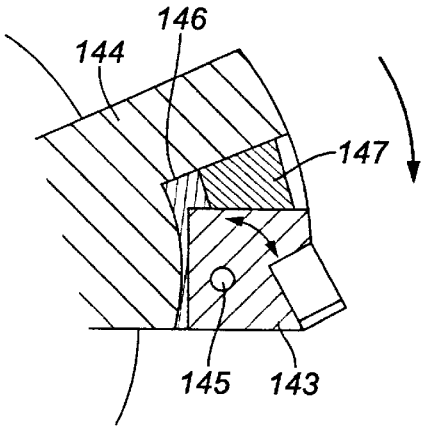
FIG. 26 diagrammatically illustrates a portion of a fourth embodiment of a drill bit having a moveable blade portion.
Figure 27:
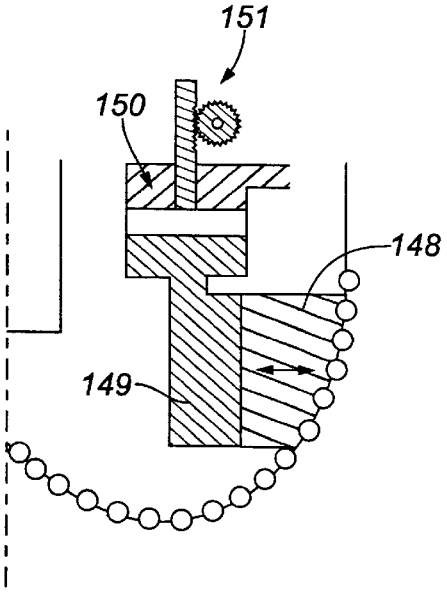
FIG. 27 diagrammatically illustrates a portion of a fifth embodiment of a drill bit having a moveable blade portion.

FIG. 26 illustrates diagrammatically, looking along the axis of rotation of the drill bit, an arrangement where the portion 143 of a blade 144 is mounted for pivoting about an axis 145 which extends generally parallel to the axis of rotation of the drill bit. The blade part 143 is pivotable in a recess 146 and a biasing device 147, of any of the kinds previously mentioned, are provided to bias the blade part 143 outwardly.

Each of the arrangements shown in FIGS. 23–26 is a passive arrangement, whereby the inward movement of the blade part occurs automatically as a result of increasing torque on the drill bit. However, as previously mentioned, active arrangements are possible where the biasing device is replaced by an operative device for positively moving the displaceable blade part inwardly or outwardly. Such an arrangement is shown diagrammatically in FIG. 27 in which a blade or blade part 148 is reciprocable in a slot 149 in the bit body and is connected to a hydraulic piston and cylinder arrangement 150 for increasing or decreasing the fluid pressure behind the blade part 148 in the slot 149. For example, the piston may be driven by a gear assembly 151 in response to a torque sensor (not shown) to adjust the position of the blade part 148 in accordance with the level of bit torque. Any of the passive arrangements of FIGS. 23 to 26 may be modified by similar means to become active arrangements.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A rotary drill bit for drilling subsurface formations, the drill bit comprising:

a bit body;

a plurality of blades disposed on the bit body;

a first plurality of formation-engaging elements disposed on at least one of the plurality of blades, the first plurality of formation-engaging elements being rigidly affixed to the bit body;

a second plurality of formation-engaging elements being disposed on at least one of the plurality of blades, the second plurality of formation-engaging elements being moveable between an extended position and a retracted position and being biased into the extended position, the extended position placing each of the second plurality of formation-engaging elements at a greater projection than the first plurality of formation-engaging elements; and a biasing member operatively coupled to each of the second plurality of formation-engaging elements.

2. The drill bit, as set forth in claim 1, comprising a plurality of sockets formed in the blade, each of the second plurality of formation-engaging elements being disposed in a respective socket.

3. The drill bit, as set forth in claim 2, comprising a retaining member disposed in each socket for coupling the respective formation-engaging element in the socket.

4. The drill bit, as set forth in claim 1, wherein each of the second plurality of formation-engaging elements comprises a cutting element.

5. The drill bit, as set forth in claim 4, wherein each cutting element comprises polycrystalline diamond.

6. The drill bit, as set forth in claim 1, wherein each of the second plurality of formation-engaging elements comprises a back-up element.

7. The drill bit, as set forth in claim 1, wherein the second plurality of formation-engaging elements are biased outwardly and move inwardly in response to formation contact.

8. The drill bit, as set forth in claim 1, wherein each of the second plurality of formation-engaging elements pivots to the retracted position in response to formation contact.

9. The drill bit, as set forth in claim 1, comprising a fluid passage formed in the bit body for delivering fluid to a surface of the bit body.

10. A rotary drill bit for drilling subsurface formations, the drill bit comprising:

a bit body;

a plurality of blades disposed on the bit body;

a first plurality of formation-engaging elements disposed on at least one of the plurality of blades, the first plurality of formation-engaging elements being rigidly affixed to the bit body;

a second plurality of formation-engaging elements being disposed on at least one of the plurality of blades, the second plurality of formation-engaging elements being moveable between an extended position and a retracted position and being biased into the extended position, the extended position placing each of the second plurality of formation-engaging elements at a greater projection than the first plurality of formation-engaging elements; and a biasing member operatively coupled to each of the second plurality of formation-engaging elements;

wherein the biasing member comprises a spring.

11. The drill bit, as set forth in claim 10, wherein each of the second plurality of formation-engaging elements comprises a cutting element.

12. The drill bit, as set forth in claim 11, wherein each cutting element comprises polycrystalline diamond.

13. The drill bit, as set forth in claim 10, wherein each of the second plurality of formation-engaging elements comprises a back-up element.

14. The drill bit, as set forth in claim 10, wherein each of the second plurality of formation-engaging elements are biased outwardly and move inwardly in response to formation contact.

15. The drill bit, as set forth in claim 10, wherein each of the second plurality of formation-engaging elements pivots to the retracted position in response to formation contact.

16. The drill bit, as set forth in claim 10, comprising a fluid passage formed in the bit body for delivering fluid to a surface of the bit body.

17. The drill bit, as set forth in claim 10, comprising a plurality of sockets formed in the blade, each of the second plurality of formation-engaging elements being disposed in a respective socket.

18. The drill bit, as set forth in claim 17, comprising a retaining member disposed in each socket for coupling the respective formation-engaging element in the socket.

19. A rotary drill bit for drilling subsurface formations, the drill bit comprising:

a bit body;

a plurality of blades disposed on the bit body;

a first plurality of formation-engaging elements disposed on at least one of the plurality of blades, the first plurality of formation-engaging elements being rigidly affixed to the bit body;

a second plurality of formation-engaging elements being disposed on at least one of the plurality of blades, the second plurality of formation-engaging elements being moveable between an extended position and a retracted position and being biased into the extended position, the extended position placing each of the second plurality of formation-engaging elements at a greater projection than the first plurality of formation-engaging elements; and a biasing member operatively coupled to each of the second plurality of formation-engaging elements;

wherein the biasing member comprises an elastomeric member.

20. The drill bit, as set forth in claim 19, wherein each of the second plurality of formation-engaging elements comprises a cutting element.

21. The drill bit, as set forth in claim 20, wherein each cutting element comprises polycrystalline diamond.

22. The drill bit, as set forth in claim 19, wherein each of the second plurality of formation-engaging elements comprises a back-up element.

23. The drill bit, as set forth in claim 19, wherein each of the second plurality of formation-engaging elements are biased outwardly and move inwardly in response to formation contact.

24. The drill bit, as set forth in claim 19, wherein each of the second plurality of formation-engaging elements pivots to the retracted position in response to formation contact.

25. The drill bit, as set forth in claim 19, comprising a fluid passage formed in the bit body for delivering fluid to a surface of the bit body.

26. The drill bit, as set forth in claim 19, comprising a plurality of sockets formed in the blade, each of the second plurality of formation-engaging elements being disposed in a respective socket.

27. The drill bit, as set forth in claim 26, comprising a retaining member disposed in each socket for coupling the respective formation-engaging element in the socket.

28. A rotary drill bit for drilling subsurface formations, the drill bit comprising:

a bit body;

a plurality of blades disposed on the bit body;

a first plurality of formation-engaging elements disposed on at least one of the plurality of blades, the plurality of formation-engaging elements being rigidly affixed to the bit body;

a second plurality of formation-engaging elements being disposed on at least one of the plurality of blades, the second plurality of formation-engaging elements being moveable between an extended position and a retracted position and being biased into the extended position, the extended position placing each of the second plurality of formation-engaging elements at a greater projection than the first plurality of formation-engaging elements; and a biasing member operatively coupled to each of the second plurality of formation-engaging elements;

wherein the biasing member comprises a compressed gas bellows.

29. The drill bit, as set forth in claim 28, wherein each of the second plurality of formation-engaging elements comprises a cutting element.

30. The drill bit, as set forth in claim 29, wherein each cutting element comprises polycrystalline diamond.

31. The drill bit, as set forth in claim 28, wherein each of the second plurality of formation-engaging elements comprises a back-up element.

32. The drill bit, as set forth in claim 28, wherein each of the second plurality of formation-engaging elements are biased outwardly and move inwardly in response to formation contact.

33. The drill bit, as set forth in claim 28, wherein each of the second plurality of formation-engaging elements pivots to the retracted position in response to formation contact.

34. The drill bit, as set forth in claim 28, comprising a fluid passage formed in the bit body for delivering fluid to a surface of the bit body.

35. The drill bit, as set forth in claim 28, comprising a plurality of sockets formed in the blade, each of the second plurality of formation-engaging elements being disposed in a respective socket.

36. The drill bit, as set forth in claim 35, comprising a retaining member disposed in each socket for coupling the respective formation-engaging element in the socket.

* * * * *